US005356316A

United States Patent [19]

Anderson

[11] Patent Number: 5,356,316

[45] Date of Patent: Oct. 18, 1994

[54] COMBINED ELECTRICAL CONNECTOR MOUNTING TRACK AND GROUNDING CONNECTOR ASSEMBLY

[75] Inventor: James D. Anderson, Norwalk, Conn.

[73] Assignee: Burndy Corporation, Norwalk, Conn.

[21] Appl. No.: 974,225

[22] Filed: Nov. 10, 1992

[51] Int. Cl.[5] ..... H01R 11/09

[52] U.S. Cl. ..... 439/724; 439/95; 439/97

[58] Field of Search ..... 439/724, 725, 716, 94, 439/110, 116, 119, 685, 695, 696, 701, 95, 96, 97, 108, 107, 535

[56] References Cited

U.S. PATENT DOCUMENTS

| | | | |
|---|---|---|---|
| 2,468,737 | 5/1949 | Davis | 439/96 |
| 3,397,384 | 8/1968 | Lawrence | 439/715 |
| 3,456,231 | 7/1969 | Paullus et al. | 439/716 |
| 3,506,947 | 4/1970 | Leskosek | 439/532 |
| 3,576,520 | 4/1971 | Stauffer | 439/716 |
| 3,597,726 | 8/1971 | Appleton | 439/724 |
| 3,725,852 | 4/1973 | Blanchet | 439/718 |
| 3,806,856 | 4/1974 | Virani et al. | 439/97 |
| 4,090,764 | 5/1978 | Malsby et al. | 439/716 |
| 4,111,517 | 9/1978 | Debaigt | 439/716 |
| 4,113,982 | 9/1978 | Glaesel | 174/158 R |
| 4,157,858 | 6/1979 | Debaigt | 439/716 |
| 4,203,638 | 5/1980 | Tansi | 439/97 |
| 4,425,018 | 1/1984 | Stenz | 439/716 |
| 4,454,382 | 6/1984 | Borne et al. | 174/158 R |
| 4,580,863 | 4/1986 | Lohr et al. | 439/695 |
| 4,581,489 | 4/1986 | Nozick | 179/98 |
| 4,854,899 | 8/1989 | Matthews | 439/724 |
| 4,906,199 | 3/1990 | Twomey et al. | 439/95 |
| 5,192,233 | 3/1993 | Suffredini et al. | 439/723 |

FOREIGN PATENT DOCUMENTS 2605464 4/1988 France .

*Primary Examiner*—Larry I. Schwartz
*Assistant Examiner*—Hien D. Vu
*Attorney, Agent, or Firm*—Perman & Green

[57] ABSTRACT

An electrical connector assembly including a grounding-mounting track and at least one ground module fixedly connected to the track. The track is adapted to have a plurality of signal modules modularly connected to it. The ground module has a housing with at least one electrical terminal therein. The electrical terminal is fixedly electrically connected to the track.

18 Claims, 4 Drawing Sheets

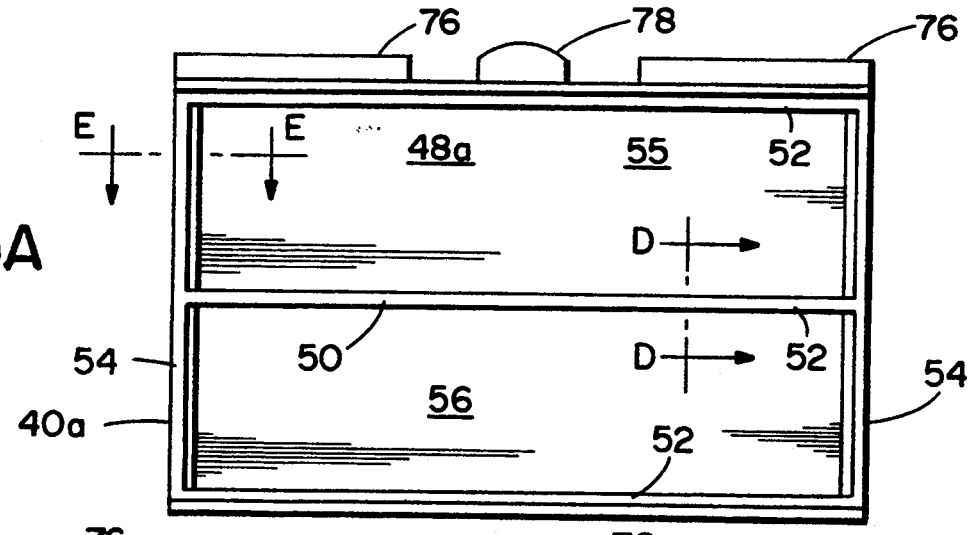
FIG. 5A
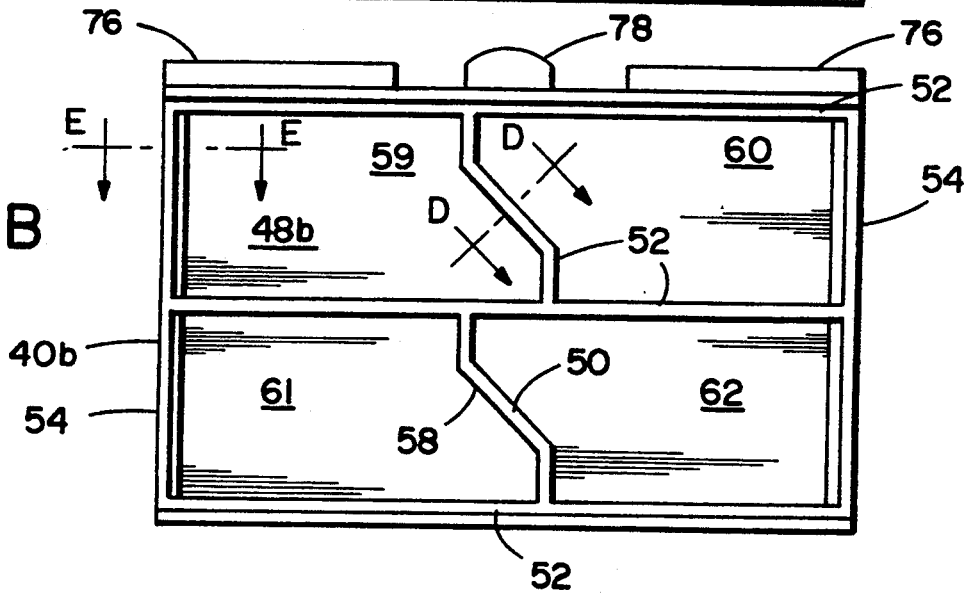
FIG. 5B
FIG. 5C
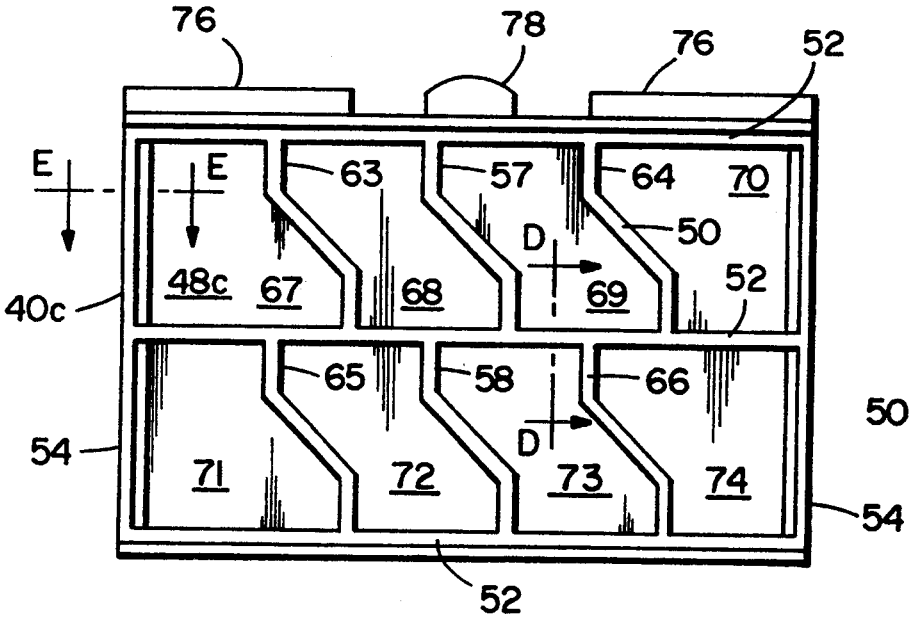
FIG. 5D
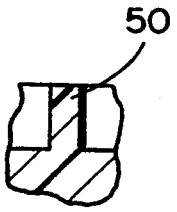
FIG. 5E
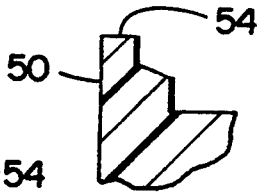

COMBINED ELECTRICAL CONNECTOR MOUNTING TRACK AND GROUNDING CONNECTOR ASSEMBLY

BACKGROUND OF THE INVENTION

1. Field of the Invention

The present invention relates to electrical connectors and, more particularly, to a combined electrical connector mounting track and grounding connector assembly.

2. Prior Art

U.S. Pat. No. 3,576,520 to Stauffer discloses a mounting track and terminal junction modules. Other relevant prior art include the following U.S. Pat. Nos.: 4,090,764; 3,456,231; 3,725,852; 3,397,384; 4,580,863; 4,425,018; 4,113,982; 4,157,858; 4,454,382; 4,581,489; 3,506,947; 4,111,517; and French Patent No. 2,605,464.

It is the object of the present invention to provide a new and improved combined electrical connector mounting track and ground connector assembly.

SUMMARY OF THE INVENTION

In accordance with one embodiment of the present invention, an electrical connector assembly is provided comprising a mounting track and at least one ground module. The mounting track is adapted to have a plurality of signal modules connected thereto. The ground module is fixedly connected to the mounting track and has a housing with at least one electrical terminal therein. The electrical terminal is fixedly electrically connected to the mounting track.

In accordance with another embodiment of the present invention, an electrical connector assembly is provided comprising a mounting track and at least one ground module. The mounting track is comprised of electrically conductive material and is adapted to have a plurality of signal modules connected thereto. The ground module comprises a housing, at least one electrical terminal located in the housing, and at least one fastener. The fastener fixedly connects the housing to the track and, mechanically and electrically fixedly connects the electrical terminal to the track.

In accordance with one method of the present invention, a method of assembling an electrical connector assembly is provided comprising steps of providing a mounting track adapted to have signal modules and ground modules connected thereto; providing a ground module housing, a ground module terminal, and a fastener; connecting a first portion of the fastener to the track with a portion of the ground module terminal therebetween to thereby fixedly connect the ground module terminal to the track; and connecting a second portion of the fastener to the ground module housing to thereby fixedly connect the housing to the track.

BRIEF DESCRIPTION OF THE DRAWINGS

The foregoing aspects and other features of the invention are explained in the following description, taken in connection with the accompanying drawings, wherein:

FIG. 5A is a plan top view of a first type of housing bottom of a terminal block for use with the housing top shown in FIG. 4.

FIG. 5B is a plan top view of a second type of housing bottom of a terminal block for use with the housing top shown in FIG. 4.

FIG. 5C is a plan top view of a third type of housing bottom of a terminal block for use with the housing top shown in FIG. 4.

FIG. 5D is a cross-sectional view of the housing bottoms shown in FIGS. 5A–5C taken along lines D—D.

FIG. 5E is a cross-sectional view of the housing bottoms shown in FIGS. 5A–5C taken along lines E—E.

DETAILED DESCRIPTION OF THE INVENTION

Figure 1:
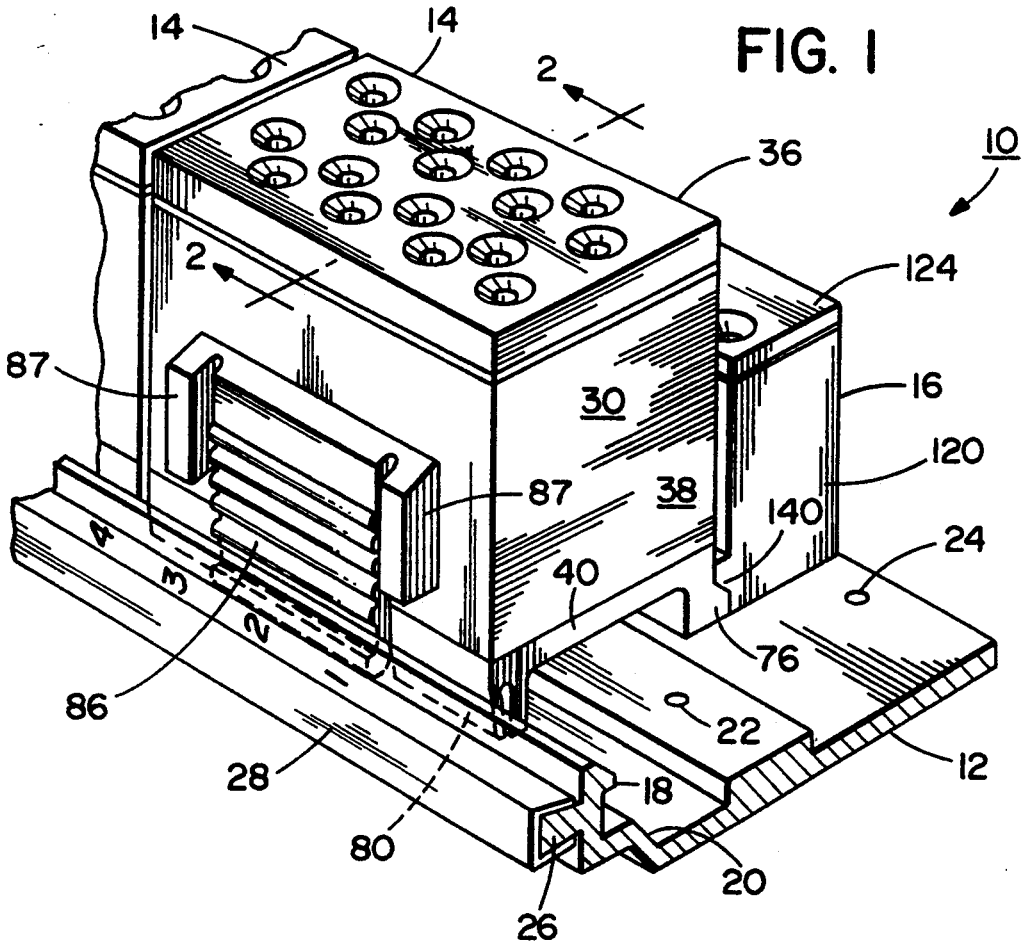
FIG. 1 is a partial perspective view of an electrical connection system incorporating features of the present invention.

Referring to FIG. 1, there is shown a partial perspective view of an electrical connection system 10 incorporating features of the present invention. Although the present invention will be described with reference to the embodiments shown in the drawings, it should be understood that the present invention can be incorporated into different types of embodiments. In addition, any suitable size, shape or type of members or materials could be used.

Figure 2:
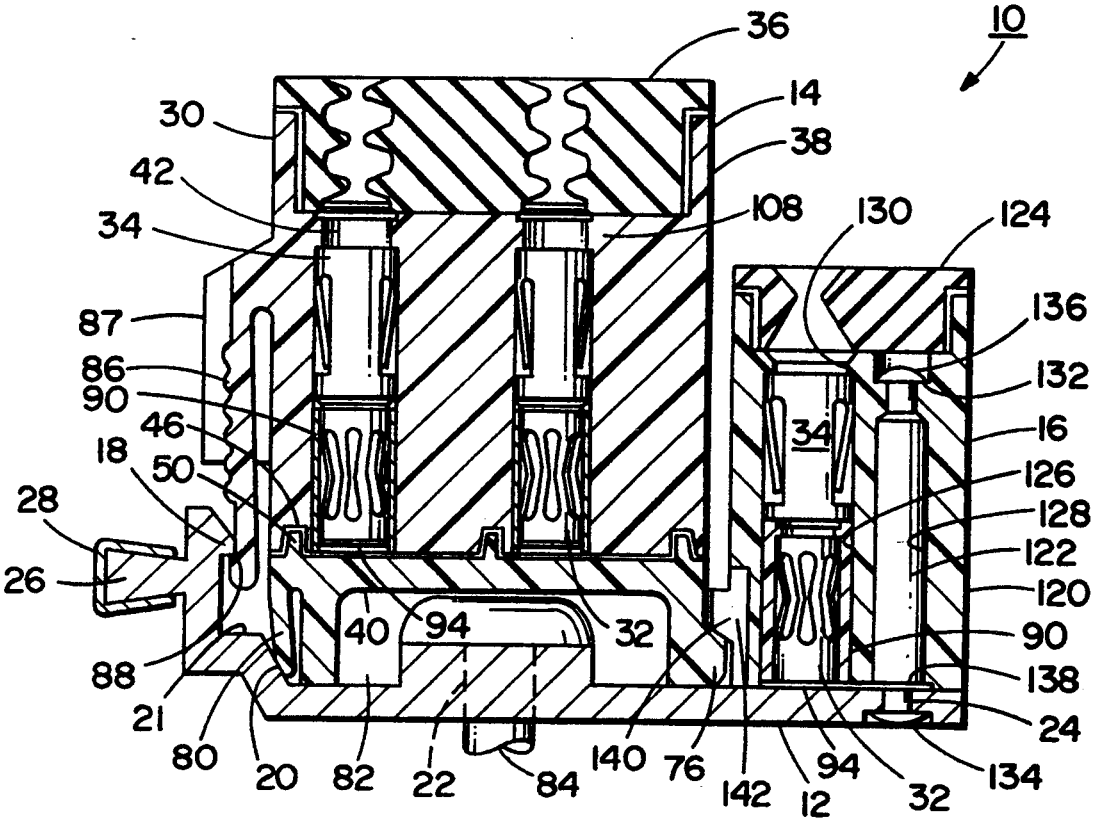
FIG. 2 is a cross-sectional view of the system shown in FIG. 1 taken along line 2—2.

Referring also to FIG. 2, the system 10 generally comprises a mounting track 12, a plurality of terminal blocks or signal connectors 14, and a plurality of grounding blocks or grounding modules 16 (only one of which is shown). In the embodiment shown, the system 10 has generally been provided for use in an aircraft. However, the system 10 can be used in any suitable type of environment. The track 12 is preferably made of electrically conductive metal. The track 12 has a snap-lock ledge 18, a cam surface 20 proximate the ledge 18, a first series of holes 22 for mounting the track 12 to a frame of the aircraft, a second series of holes 24 for mounting the grounding blocks 16 to the track 12, and a lateral ridge 26 for mounting a marking strip 28 along the length of the track 12. In a preferred embodiment, the track is adapted to have a plurality of signal connectors removably snap-lock connected to it and, a plurality of grounding blocks fixedly connected to the track.

Figure 4:
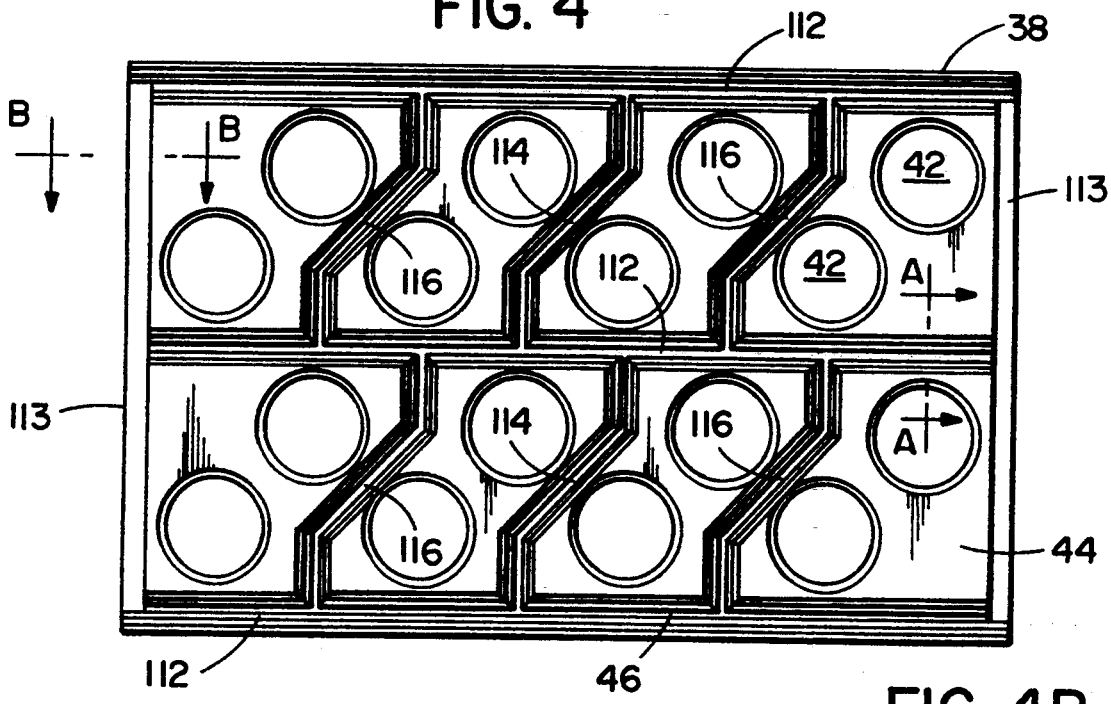
FIG. 4 is a plan bottom view of the housing top of the terminal block for the system shown in FIG. 1.
Figure 4A:
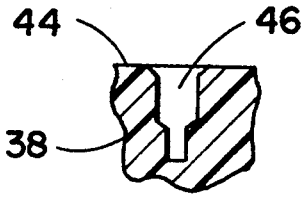
FIG. 4A is a cross-sectional view of the housing top shown in FIG. 4 taken along line A—A.

The signal connectors or terminal blocks 14 each comprise a housing 30, at least one terminal 32, retaining clips 34, and a grommet 36. The housing 30 is comprised of a housing top 38 and a housing bottom 40 made of a dielectric material. FIG. 4 shows a bottom view of the housing top 38 shown in FIG. 2. The top 38 has a plurality of contact receiving areas 42. The bottom surface 44 of the top 38 has a pattern of grooves 46 extending into the bottom surface. A cross-sectional view at the grooves 46 before connection of the housing top and housing bottom to each other is shown in FIG. 4A. In the embodiment shown, the housing top 38 has sixteen contact receiving areas 42 that are grouped in sets of two and separated by the pattern of grooves 46. However, any suitable number of contact receiving areas 42 could be provided, any pattern of grooves 46 could be provided, and any type of sets of receiving areas 42 could be provided. In the embodiment shown, the housing top 38 is adapted to be used with any one of the housing bottoms 40*a*, 40*b*, 40*c* shown in FIGS. 5A–5C as further understood below. Located on one side of the top 38 is a snap-lock latch 86. The latch 86 extends from the top 38 in general cantilever fashion and includes a snap-lock ledge 88. The top 38 is preferably made of a polymer material such that the latch 86 can be deflected towards the top 38. In the embodiment shown, located on opposite sides of the latch 86 are studs 87 adapted to prevent inadvertent or accidental movement of the latch 86.

In the embodiment shown in FIG. 2, the third type of housing bottom 40*c* shown in FIG. 5C, is being used. The top surfaces 48*a*, 48*b*, 48*c* of the bottoms 40*a*, 40*b*, 40*c* each have a different pattern of tongues 50 (see FIGS. 5D and 5E). All three types of bottoms 40*a*, 40*b*, 40*c* have a long tongue 52 extending from their top surfaces along the center of the surface and, surrounding peripheral tongues 54 also extending from their top surfaces. The first type of bottom 40*a* has no other tongues and thus establishes the two areas 55, 56. The second type of bottom 40*b* has two additional tongues 57, 58 that have a general zig-zag shape and extend between the center tongue 52 and the end tongues 54. Thus, four areas 59, 60, 61, 62 are established. The third type of bottom 40*c* has the tongues 57, 58 and four additional general zig-zag shaped tongues 63, 64, 65, 66 to establish eight areas 67, 68, 69, 70, 71, 72, 73, 74. Of course, any suitable type of tongue pattern can be provided.

Each of the three types of bottoms 40*a*, 40*b*, 40*c* also comprise toes 76 and a key 78 on a first side and, a spring leg 80 (see FIG. 2) on an opposite second side. A space 82 is provided at the underside of the bottoms 40 to allow the terminal blocks 14 to be mounted over fasteners 84 that fasten the track 12 to the aircraft frame. The spring leg 80 preferably extends from the bottom 40 in a general cantilever fashion. The bottom 40 is preferably made of a polymer material such that the spring leg 80 is deflectable towards the toes 76. The spring leg 80 is located on the same side of the terminal block 14 as the snap-lock latch 86 and is deflectable in the same direction. The spring leg 80 is generally parallel to the latch 86. However, any suitable type of spring or spring leg could be provided. The bottom 40 is positioned with its tongues 50 located in the grooves 46 of the top 38 and ultrasonically welded to thereby fix the bottom 40 to the top 38 and from a seal at the welded areas of the tongues in the grooves. Of course, any suitable type of connection and sealing method could be used.

Figure 6:
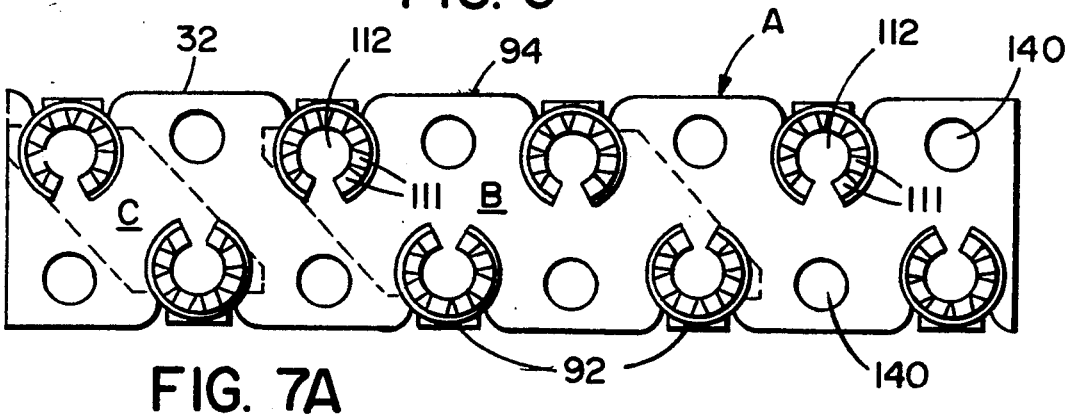
FIG. 6 is a plan top view of a contact terminal for use with the first type of housing bottom shown in FIG. 5A and showing in dashed lines configurations of two other contact terminals for use with the two other types of housing bottoms shown in FIGS. 5B and 5C.

Prior to connecting the bottom 40 to the top 38, the terminals 32, retaining clips 34, and contact spacers 90 (see FIGS. 8A and 8B) are inserted into the receiving areas 42. Referring also to FIG. 6, the contact terminals 32 preferably comprise a plurality of socket contacts 92 interconnected by a busing strip 94. Of course, any suitable type of terminals could be provided. In addition, the contact spacers need not be provided and, the retaining clips 34 could be provided as integrally formed with the terminals 32.

Figure 7A:
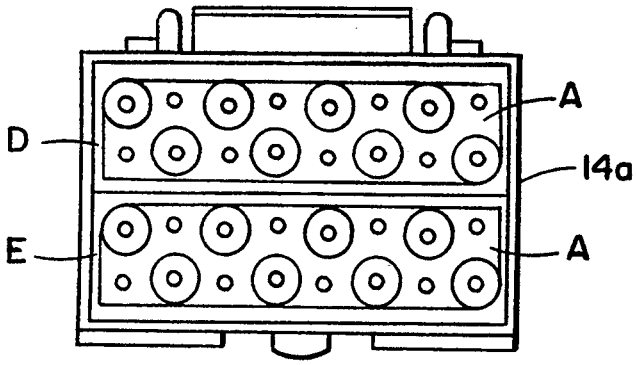
FIGS. 7A, 7B, and 7C are schematic plan top views of three different types of terminal blocks.
Figure 7B:
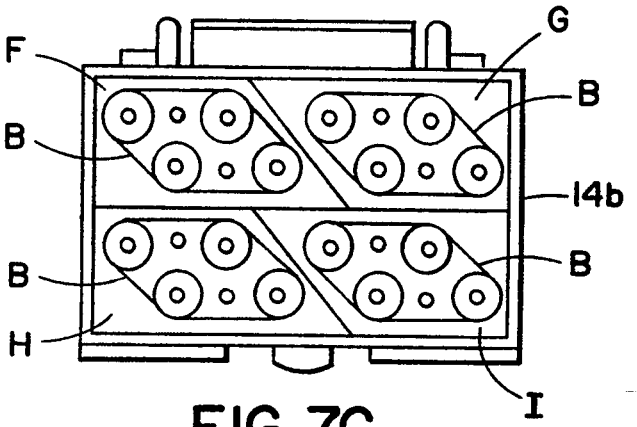
Figure 7C:
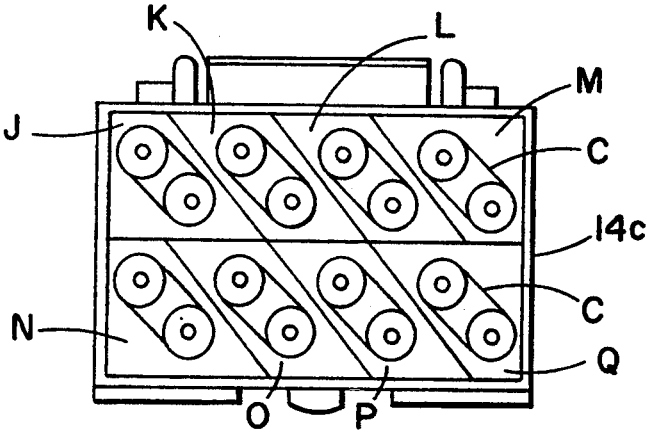

In a preferred embodiment, the terminals 32 are provided with eight contacts 92 as shown as A in FIG. 6, or four contacts 92 as illustrated by area B in dashed lines in FIG. 6, or two contacts 92 as illustrated by area C in dashed lines in FIG. 6. However, any suitable number of contacts can be provided on each terminal. FIG. 7A schematically illustrates an embodiment of a first signal connector 14*a* that comprises two A terminals (each having eight contacts) with the bottom 40*a* shown in FIG. 5A. FIG. 7B schematically illustrates an embodiment of a second signal connector 14*b* that comprises four B terminals (each having four contacts) with the bottom 40*b* shown in FIG. 5B. FIG. 7C schematically illustrates an embodiment of a third signal connector 14*c* that comprises eight C terminals (each having two contacts) with the bottom 40*c* shown in FIG. 5C. A discussion of these three embodiments and their assembly is further described below. The terminals 32 are preferably comprised of sheet metal that has been cut and preformed to provide a one-piece terminal having multiple contacts 92 electrically and mechanically interconnected to each other by the busing strip 94. In the embodiment shown, the contacts 92 are female contacts with eight inwardly bent spring legs 111 that form male contact receiving areas 112. However, any suitable type of contacts could be provided. The housing 30 is preferably adapted to be useable with terminals having any one of a number of different size contacts, each having different size receiving areas 112 to be able to receive different size male contacts. Therefore, it should be noted that any suitable type of terminals could be used.

Figure 8A:
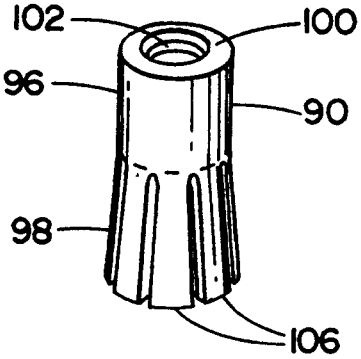
FIG. 8A is a perspective view of a contact spacer used in the terminal block shown in FIG. 3.
Figure 8B:
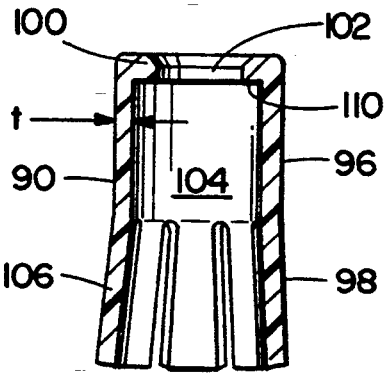
FIG. 8B is a cross-sectional view of the contact spacer shown in FIG. 8A.

Referring also to FIGS. 8A and 8B, a contact spacer 90 is shown before insertion into the housing top 38. The spacer 90 is preferably comprised of a dielectric polymer or plastic material and includes a top section 96 and a bottom section 98. The top section 96 has a top ledge 100 with an aperture 102 passing through the ledge 100 into a general bell shaped interior receiving area 104. The bottom section 98 has a plurality of flared legs 106. Each of the legs 106 extends in general cantilever fashion from the top section 96 and flares away from the center longitudinal of the spacer 90. The spacer material is a deflectable material such that the legs 106 can be deflected in towards the center axis. As seen best in FIG. 2, the housing top contact receiving areas 42 have stop ledges 108 at their tops. The retainer clips 34 are inserted into the areas 42 and are stopped at the ledges 108. Prior to inserting the contacts 92 of the terminals 32 into the areas 42, the spacers 90 are positioned over the contacts 92. The contacts 92 are received in the receiving areas 104 and a bottom surface 110 of the ledge 100 contacts the top of the contact 92 to thereby precisely position the contact and spacer relative to each other. With the spacers 90 positioned on the contacts 92, they are inserted into the contact receiving areas 42 through the bottom of the housing top. As the spacers 90 are inserted, the interior walls of the areas 42 cause the legs 106 to be deflected or deformed inward. When fully inserted, the legs 106 are compressed by the top housing to grab the contacts 92, thereby friction holding the contacts 92 to the spacers 90. The legs 106 also form a friction hold of the spacers 90 with the top housing 38. The top surface of each of the spacer ledges 100 contact the bottom of a retainer clips 34 and thereby sandwich the retainer clips 34 between the ledges 108 and the ledges 100. In the embodiment shown, the aperture 102 is smaller than the receiving space 104, and is adapted to limit the size of a male contact (not shown) that can be inserted through the aperture 102 into the female contact 92. The aperture is smaller than a potential expanded size of a male contact receiving area 112 (see FIG. 6) of the female contact to thereby protect the female contact 92 from having an oversize male contact connected to it; thereby preventing the female contact 92 from damage by an oversized male contact. In a preferred embodiment, the inner perimeter of the spacers 90 proximate the top shelf 100 is slightly smaller than the outer perimeter of a top of the female contact 92 to thereby form a friction hold even before the contacts 92 and spacers 90 are inserted in the top housing 38. The thickness of the spacers 90 is suitably selected based upon the diameter of the receiving areas 42 and the outer diameter of the contacts 92. Thus, the housing top 38 can be used with different size female contacts by selecting spacers with an appropriate thickness. Of course, the spacers 90 need not be provided or, alternate forms of spacers could be provided.

Figure 4B:
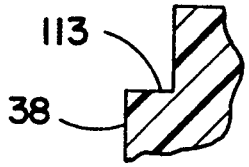
FIG. 4B is a cross-sectional view of the housing top shown in FIG. 4 taken along line B—B.

Once the retainer clips 34, spacers 90, and contacts 92 are inserted into the receiving areas 42, the housing bottom 40 is then connected to the housing top 38. For the embodiment shown in FIG. 7A, the busing strips 94 of the two terminal A and A extend along the bottom of the housing top 38 and are sandwiched between the top and bottom housings; one at area 55 and one at area 56 (see FIG. 5A). The tongues 52 extends into grooves 112 and the tongues 54 extend into grooves 113. When ultrasonically welded, the housing top and bottom form two sealed areas D and E; thereby sealing off the A terminals from each other. The grommet 36 is then connected to the housing top 38 by suitable means, such as epoxy adhesive. The grooves 114 and 116 do not have tongues located in them. Rather, the busing strips 94 are located between the housing top and housing bottom at these grooves 114, 116. For the embodiment shown in FIG. 7B, the tongues 57 and 58 (see FIG. 5B) also extend into the grooves 114 (see FIG. 4) and, when ultrasonically welded, form the four sealed off areas F, G, H, I (see FIG. 7B) each area with a single B terminal. The grooves 116 do not have tongues located in them. Thus, no seal is formed at grooves 116. For the embodiment shown in FIG. 7C, the tongues 63, 64, 65, 66 (see FIG. 5C) also extend into the grooves 116 (see FIG. 4) and, when ultrasonically welded, form the eight sealed off areas J, K, L, M, N, O, P, Q (see FIG. 7C); each area with a single C terminal. As can be seen by comparing FIGS. 4A and 5D and, FIGS. 4B and 5E, the cross-sectional shape of the grooves and tongues are different prior to ultrasonic welding. This helps provide good welding by allowing a good flow of material.

Referring now to FIGS. 1 and 2, the ground modules 16 will be described. The ground modules 16 each generally comprise a housing 120, a contact terminal 32, long rivet-type fasteners 122, a grommet 124, retainer clips 34, and spacers 90. The housing 120 is preferably made of a molded polymer material, but may also be comprised of metal. The housing 120 has a plurality of contact receiving apertures 126 and a plurality of fastener receiving apertures 128. Similar to the signal module 14, the retainer clips 34 in the ground module 16 are inserted into the receiving apertures 126, followed by the spacers 90 and contacts 92, to sandwich the retainer clips 34 between a ledge 130 of the housing 120 and the top shelf 100 of the spacers 90. The spacers 90 form a friction hold of the contacts 92 and the housing 120 inside the receiving apertures 126. The fastener receiving apertures 128 include a top ledge 132. The fasteners 122 have a first head at a first end 134 and a second head at a second end 136. The first end 134 also includes a ledge 138. As can be seen in FIG. 6, the busing strip 94 includes holes 140. Portions of the fastener first ends 134 extend through these holes 140. The ledge 138 is thus allowed to abut against the top surface of the busing strip 94.

The grounding module 16, in the embodiment shown, is fixedly attached to the track 12 by the fasteners 122. The fasteners 122 not only fasten the housing 120 to the track 12, but also electrically and mechanically fasten the terminal 32 to the track 12. Thus, the track 12 functions not only as a mounting track, but also as a grounding-mounting track. The assembly and mounting of the grounding module 16 generally comprise the following steps. The fasteners 122 are positioned in the fastener receiving apertures 128. The ends 134 and 136 have not yet been deformed. The retainer clips 34, contacts 92 and spacers 90 are positioned into the receiving apertures 126. The busing strip 94 is located adjacent the bottom of the housing 120 with the first ends 134 of the fasteners 122 extending through the holes 140 in the busing strip 94. The bottom of the housing 120 and the busing strip 94 are then positioned against the track 12 with the fastener first ends 134 extending into the holes 24 in the track 12. The two ends 134 and 136 of the fasteners 122 are deformed to form the rivet-like heads shown in FIG. 2. The rivet-like head at the first end 134 and the ledge 138 cooperate to form a good electrical connection of the busing strip 94 with the track 12. The rivet-like head at the second end 136 acts against top ledge 132 to keep the housing 122 attached to the track 12. After the fastener 122 has its two opposing heads formed, the grommet 124 is then attached to the housing 120, such as by use of epoxy adhesive (not shown).

One of the unique features of the grounding module 16 is its ability to cooperate with the track 12 in the mounting of the signal modules 14 to the track 12. One side of the housing 120 includes two toe ledges 140 located on opposite sides of a key receiving area 142. The key receiving area 142 is suitably sized and shaped to have the key 78 inserted into it. The toe ledges 140 are suitably sized and shaped to have the toes 76 inserted under them.

The mounting of the signal modules 14 to the track 12 will now be described. After the track 12 with attached ground modules 16 is attached to the frame of an aircraft, the signal modules 14 are merely snap-lock connected to the track 12. First, the first side of the signal module 14 is positioned with the toes 76 positioned under the ledges 140 and the key 78 located in the key receiving area 142. The toes 76 act as locking portions to at least partially assist in mounting the signal connector 14 to the track (via the ground module). The second side of the signal module 14 is then pushed down. The snap-lock latch 86 is deflected and wedged in by the top ramp on the snap-lock ledge 18. The spring leg 80 is also deflected and wedged in by the cam surface 20. The deflection and deformation of the spring leg 80 causes the signal module 14 to be pushed against the ground module 16. As the module snap-lock ledge 88 passes the lower portion of the track snap-lock ledge 18, the snap-lock latch 86 snaps into its final position as shown in FIG. 2. This prevents the forces generated by the spring leg 80 from pushing the module 14 off of the track 12. The key 78 must be located in the key receiving area 142 in order for the signal module 14 to be mounted to the track 12 because the spring leg 80 would otherwise hit surface 21 (not cam surface 20). When the spring leg 80 hits surface 21, the spring leg 80 prevents further downward motion of the housing 30 and, thus, prevents the latch 86 from connecting with ledge 18. Only when the key 78 is located in key receiving area 142 is the spring leg 80 located over the cam surface 20. The toes 76 and toe ledges 140 both have sloped surfaces to insure a tight and snug fit of the toes 76 under the ledges 140 due to the biasing action of the spring leg 80. Once connected, the signal module 14 can be removed from the track 12 by merely depressing the snap-lock latch 86 and tilting the module 14, sliding the toes 76 out from under the toe ledges 140, and removing the module 14. The purpose of providing the connection system described above is primarily due to the environment for which the system was designed; an aircraft. Thus, a lightweight and dependable system was needed that could easily endure the vibrations encountered on an aircraft frame without the signal or ground modules vibrating on the track and, without risk that the modules might inadvertently become dismounted from the track.

Figure 3:
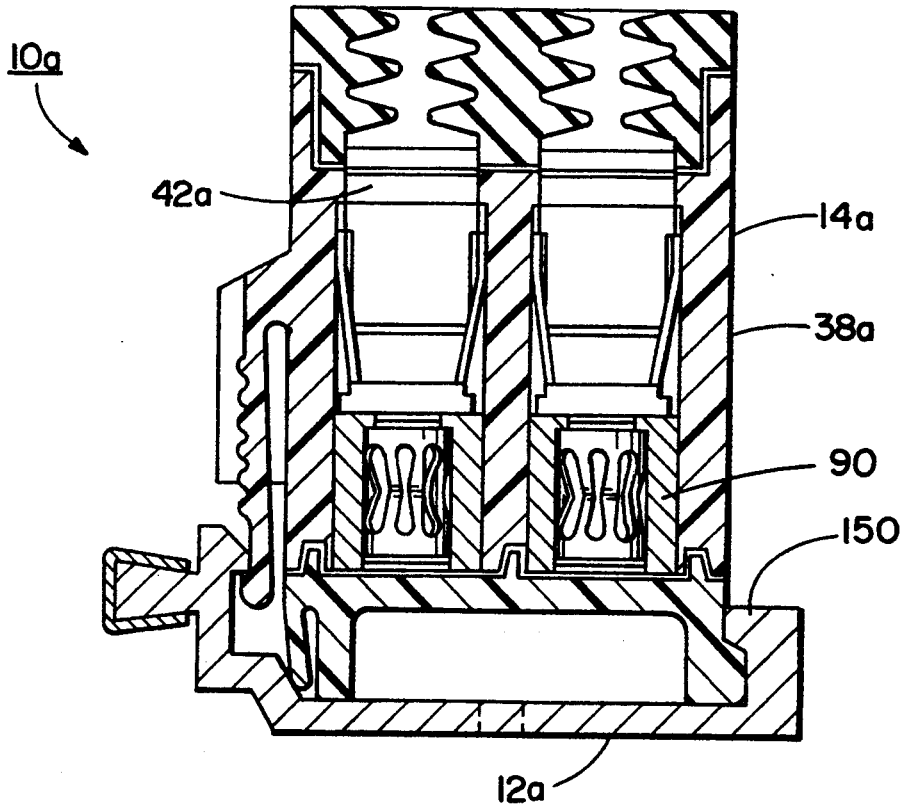
FIG. 3 is a cross-sectional view of an alternate embodiment of the present invention.

Referring to FIG. 3, there is shown an alternate embodiment of the present invention. In the embodiment shown, the system 10*a* does not include ground modules. The system 10*a* has a track 12*a* with a toe ledge 150 and key receiving area (not shown). Thus, as demonstrated with this embodiment, combined track and ground modules need not be provided. In addition, any suitable type of track may be provided. The signal module 14*a* is slightly different than the signal modules described above. In particular, the signal module 14*a* has a housing top 38*a* with relatively large contact receiving apertures 42*a* in order to accommodate larger male contacts.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector assembly comprising:

a grounding-mounting track adapted to have a plurality of signal modules removably snap-lock connected thereto; and at least one ground module fixedly connected to the grounding-mounting track, the ground module having a housing with at least one electrical terminal therein, and a ledge integral with the housing for a portion of a signal module to be located against to support snap-lock connection of the signal module to the track, the electrical terminal being fixedly electrically connected to the mounting track.

2. An assembly as in claim 1 wherein the mounting track is comprised of electrically conductive material.

3. An assembly as in claim 1 wherein the electrical terminal comprises a plurality of female electrical contacts connected by a busing strip.

4. An assembly as in claim 3 wherein the busing strip is connected to the track at a plurality of locations.

5. An assembly as in claim 1 further comprising at least one fastener having a first end connecting the electrical terminal to the track, and a second end connected to the housing.

6. An assembly as in claim 5 wherein the fastener is a long double headed rivet.

7. An electrical connector assembly comprising:

a grounding-mounting track comprised of electrically conductive material, the track being adapted to have a plurality of signal modules directly removably snap-lock connected thereto; and at least one ground module comprising a housing, at least one electrical terminal located in the housing, and at least one fastener, the fastener fixedly connecting the housing to the track and, mechanically and electrically fixedly connecting the electrical terminal to the track.

8. An assembly as in claim 7 wherein the fastener is a double headed long rivet.

9. An assembly as in claim 7 wherein the electrical terminal comprises a plurality of female electrical contacts connected by a busing strip.

10. An assembly as in claim 9 wherein the busing strip is connected to the track at a plurality of locations.

11. An assembly as in claim 8 wherein a first end of the rivet connects the electrical terminal to the track and, a second end of the rivet is connected to the housing.

12. An assembly as in claim 11 wherein the rivet first end has a shaft section that extends through holes in the electrical terminal and the track and, a ledge abutting against a top surface of a busing strip of the electrical terminal.

13. A method of assembling an electrical connector assembly comprising steps of:

providing a grounding-mounting track adapted to have signal modules and ground modules connected thereto;

providing a ground module housing, a ground module terminal, and a fastener;

connecting a first portion of the fastener to the track with a portion of the ground module terminal therebetween to thereby fixedly connect the ground module terminal to the track;

connecting a second portion of the fastener to the ground module housing to thereby fixedly connect the housing to the track; and removably snap-lock mounting a signal module directly to the track adjacent the ground module housing.

14. A method as in claim 13 wherein the step of providing a fastener comprises providing a double headed long rivet, the first portion being a first end and the second portion being a second end.

15. A method as in claim 14 wherein the first end of the rivet has a ledge that is abutted against a busing section of the terminal.

16. A method as in claim 15 wherein a portion of the first end is deformed to sandwich portions of the track and busing section between the ledge and the deformed portion of the first end.

17. A method as in claim 14 wherein the housing is abutted against the track, the first end is deformed to fixedly connect the rivet to the track, and the second end is deformed to hold the housing against the track.

18. An electrical connector assembly comprising:

a grounding-mounting track adapted to have a plurality of signal modules and ground modules connected thereto; and at least one ground module fixedly connected to the grounding-mounting track, and the ground module having a housing with at least one electrical terminal therein, the electrical terminal being fixedly electrically connected to the mounting track by a double headed rivet with a ledge of the rivet abutting against a portion of the electrical terminal at a first end of the rivet that connect the electrical terminal to the track and an opposite second end of the rivet connecting the housing to the track.

* * * * *